US009196406B2

(12) United States Patent
Leipold et al.

(10) Patent No.: US 9,196,406 B2
(45) Date of Patent: Nov. 24, 2015

(54) HIGH Q FACTOR INDUCTOR STRUCTURE

(71) Applicant: RF Micro Devices, Inc., Greensboro, NC (US)

(72) Inventors: Dirk Robert Walter Leipold, San Jose, CA (US); Danny W. Chang, San Francisco, CA (US); George Maxim, San Jose, CA (US); Ruediger Bauder, Feldkirchen-Westerham (DE)

(73) Assignee: RF Micro Devices, Inc., Greensboro, NC (US)

( * ) Notice: Subject to any disclaimer, the term of this patent is extended or adjusted under 35 U.S.C. 154(b) by 0 days.

(21) Appl. No.: 14/099,007

(22) Filed: Dec. 6, 2013

(65) Prior Publication Data

US 2014/0266544 A1 Sep. 18, 2014

Related U.S. Application Data

(60) Provisional application No. 61/789,693, filed on Mar. 15, 2013, provisional application No. 61/831,666, filed on Jun. 6, 2013, provisional application No. 61/860,932, filed on Aug. 1, 2013, provisional application No. 61/909,028, filed on Nov. 26, 2013.

(51) Int. Cl.

| | |
|---|---|
| ***H01F 5/00*** | (2006.01) |
| ***H01F 27/29*** | (2006.01) |
| ***H01F 27/28*** | (2006.01) |
| ***H01F 17/00*** | (2006.01) |

(52) U.S. Cl.

CPC ..... *H01F 5/003* (2013.01); *H01F 17/0013* (2013.01); *H01F 2017/002* (2013.01); *H01F 2017/0073* (2013.01)

(58) Field of Classification Search

CPC ..... H01F 5/003; H01F 17/0013; H01F 2017/0073; H01F 2017/002; H01F 27/2804

USPC ..... 336/220, 223, 192, 186; 257/531, 48, 257/421, 427, 621

See application file for complete search history.

(56) References Cited

U.S. PATENT DOCUMENTS

| | | | |
|---|---|---|---|
| 5,517,083 | A | 5/1996 | Whitlock |
| 7,262,680 | B2 | 8/2007 | Wang |

(Continued)

FOREIGN PATENT DOCUMENTS

| | | | |
|---|---|---|---|
| KR | 20110114238 | A | 10/2011 |
| WO | 0146971 | A1 | 6/2001 |

OTHER PUBLICATIONS

Duplessis, M., et al., "Physical implementation of 3D integrated solenoids within silicon substrate for hybrid IC applications," presented at the European Microwave Conference, Sep. 29-Oct. 1, 2009, Rome, IEEE, pp. 1006-1009.

(Continued)

*Primary Examiner* — Mangtin Lian

(74) *Attorney, Agent, or Firm* — Withrow & Terranova, P.L.L.C.

(57) ABSTRACT

The present disclosure provides a vertical inductor structure in which the magnetic field is closed such that the magnetic field of the vertical inductor structure is cancelled in the design direction outside the vertical inductor structure, yielding a small, or substantially zero, coupling factor of the vertical inductor structure. In one embodiment, several vertical inductor structures of the present disclosure can be placed in close proximity to create small resonant circuits and filter chains.

31 Claims, 8 Drawing Sheets

(56) References Cited

U.S. PATENT DOCUMENTS

| | | | | |
|---|---|---|---|---|
| 7,733,207 | B2 * | 6/2010 | Yun et al. | 336/200 |
| 7,973,633 | B2 * | 7/2011 | Noma et al. | 336/200 |
| 2002/0095778 | A1 * | 7/2002 | Ahn et al. | 29/604 |
| 2005/0150106 | A1 | 7/2005 | Long et al. | |
| 2007/0085648 | A1 | 4/2007 | Lee et al. | |
| 2008/0002380 | A1 | 1/2008 | Hazucha et al. | |
| 2008/0099884 | A1 | 5/2008 | Inohara | |
| 2008/0164967 | A1 | 7/2008 | Mashino | |
| 2008/0176135 | A1 * | 7/2008 | Byun et al. | 429/178 |
| 2008/0297299 | A1 | 12/2008 | Yun et al. | |
| 2008/0303623 | A1 * | 12/2008 | Hsu et al. | 336/200 |
| 2009/0261936 | A1 | 10/2009 | Widjaja et al. | |
| 2012/0268229 | A1 | 10/2012 | Yen et al. | |
| 2015/0061680 | A1 | 3/2015 | Leskowitz | |
| 2015/0102887 | A1 | 4/2015 | Park | |
| 2015/0226950 | A1 | 8/2015 | Booth et al. | |

OTHER PUBLICATIONS

Kamali-Sarvestani, R., et al., "Fabrication of High Quality Factor RF-Resonator Using Embedded Inductor and Via Capacitor," presented at IECON 2010-36th Annual Conference on IEEE Industrial Electronics Society, Nov. 7-10, 2010, Glendale, Arizona, IEEE, 5 pages.

Invitation to Pay Additional Fees for PCT/US2014/030188, mailed Jul. 4, 2014, 8 pages.

International Search Report and Written Opinion for PCT/US2014/030188, mailed Sep. 5, 2014, 19 pages.

Non-Final Office Action for U.S. Appl. No. 14/450,156, mailed Sep. 9, 2015, 13 pages.

International Preliminary Report on Patentability for PCT/US2014/030188, mailed Sep. 24, 2015, 13 pages.

* cited by examiner

HIGH Q FACTOR INDUCTOR STRUCTURE

RELATED APPLICATIONS

This application claims the benefit of U.S. Provisional Patent Application Ser. No. 61/789,693, filed Mar. 15, 2013; U.S. Provisional Patent Application Ser. No. 61/831,666, filed Jun. 6, 2013; U.S. Provisional Patent Application Ser. No. 61/860,932, filed Aug. 1, 2013; and U.S. Provisional Patent Application Ser. No. 61/909,028, filed Nov. 26, 2013, the disclosures of which are hereby incorporated herein by reference in their entireties.

FIELD OF THE DISCLOSURE

The present disclosure is directed to an inductor structure. More specifically, the disclosure relates to an inductor structure having a high quality (Q) factor and a small, or substantially zero, coupling factor.

BACKGROUND

Consumers are demanding increasingly sophisticated functionality from their mobile devices. For instance, the ability to have a video chat over a wireless network on a mobile phone is a sophisticated and complicated type of service mobile phones are expected to offer. The demand for increased functionality increases the complexity of the underlying circuitry of a mobile device and decreases the amount of space on the circuit board for various types of circuitry of the mobile device. One of the most complex and space-consuming types of circuitry in a mobile device is the signal processing circuitry. In particular, resonant circuits, within the signal processing circuitry, possess inductors, which are typically difficult to miniaturize or condense into smaller areas of a mobile device circuit board.

The difficulty in miniaturizing or condensing inductors is due to design limitations in achieving a high quality (Q) factor and a small coupling factor. The Q factor of an inductor is the ratio of the inductor's inductive reactance to its resistance at a given frequency, and is a measure of the inductor's efficiency. High internal resistances lower the Q factor of an inductor.

Inductor Q factors are commonly the limiting design factor for the insertion loss of passive filters and impedance matching circuits that are commonly found in front end modules, antenna tuners, tunable band pass filters, duplexers, and similar resonant circuits. Inductors used in these applications need to provide good isolation to avoid signal leakage. Isolation between current planar inductors is limited by a coupling factor resulting from the magnetic field generated across the design plane, as shown in FIG. 1. The magnetic field is open outside of an inductor 10, and without any field cancellation, the inductor 10 picks up the magnetic field of an inductor 12, and vice versa, increasing the coupling factor between the inductors 10 and 12.

One known method of solving the isolation design limitations presented in FIG. 1 is to simply widen the distance between the inductor 10 and the inductor 12 so the inductors 10 and 12 do not pick up each other's magnetic fields. This solution simply is not viable in resonant circuitry on mobile device circuit boards as the circuit board space is simply not available.

Another known method of solving the isolation problem shown in FIG. 1 is to "fold" the circular inductors 10 and 12 into a folded figure eight design. The coupling factor between the inductors 10 and 12 is reduced or improved, but the magnetic field still runs across the design plane, such that significant spacing is still needed between the inductors 10 and 12 and underpass circuitry connected to this known solution can be complex.

Still another known method of solving the isolation design limitations shown in FIG. 1 is to create a vertical coil inductor within a multi-layered substrate, such as a laminate, utilizing standard tube vias. Placing the coil inductor vertically within the multi-layered substrate, instead of horizontally as shown in FIG. 1, enables the magnetic field to run parallel to the design plane, reducing the coupling factor of the inductor. However, standard tube vias limit inductor performance. When placing multiple tube vias in parallel, to create a coil, the required spacing between standard tube vias limits the metal density of the inductor, limiting the Q factor. Also, the magnetic field of the inductor will cause the current to be restricted to a very small effective area of the standard tube vias, further limiting the Q factor.

Thus, there is need for a high Q factor vertical inductor with a small, or substantially zero, coupling factor that does not take up a significant amount of space on a circuit board of a mobile device.

SUMMARY

The present disclosure provides a vertical inductor structure in which a magnetic field is closed such that the magnetic field generated by the vertical inductor structure is cancelled in the design direction outside the vertical inductor structure, yielding a small, or substantially zero, coupling factor of the vertical inductor structure. In one embodiment, several vertical inductor structures of the present disclosure can be placed in close proximity to create small resonant circuits and filter chains.

The vertical inductor structure of the present disclosure, created in a substrate, comprises two or more solid via columns. With respect to an embodiment with at least four solid via columns, each of the at least four solid via columns comprises at least one solid via bar. The vertical inductor structure of the present disclosure also comprises at least three connector plates, the at least three connector plates connect the at least four solid via columns. The vertical inductor structure of the present disclosure further comprises at least two terminal plates, where the at least two terminal plates comprise a terminal connection for the vertical inductor structure in the substrate. In a first embodiment of the present disclosure, the at least two terminal plates of the vertical inductor structure are located on a top of the vertical inductor structure. In a second embodiment of the present disclosure, the at least two terminal plates of the vertical inductor structure are located on a bottom of the vertical inductor structure.

The terminal plates and connector plates of the vertical inductor structure of the present disclosure are created in conductive layers of a substrate, such as a laminate. The solid via bars of the at least four solid via columns are created in non-conductive layers of the substrate, wherein a height of each solid via bar corresponds with a depth of a non-conductive layer in the substrate. The at least four solid via columns are created by stacking several of the solid via bars between conductive layers in the substrate. The at least four solid via columns connect the at least two terminal plates and the at least three connector plates etched in the conductive layers in order to create the vertical inductor structure of the present disclosure in the substrate.

The high Q factor and the small coupling factor of the vertical inductor structure of the present disclosure can be adjusted by either increasing or decreasing widths of the at least four solid via columns. The widths of the at least four solid via columns can be increased to improve the metal density of the vertical inductor structure and to achieve a high Q factor without increasing the inductive resistance of the vertical inductor structure of the present disclosure. In a first embodiment, the magnetic field of the vertical inductor structure of the present disclosure is closed to an interior of the vertical inductor structure when the widths of each of the at least four solid via columns are equal in size. The coupling factor is small, or substantially zero, when the magnetic field of the vertical inductor structure of the present disclosure is closed to the interior of the vertical inductor structure. However, in a second embodiment, the widths of the at least four solid via columns are not equal, thus enabling the magnetic field of the vertical inductor structure of the present disclosure to leak outside the vertical inductor structure to obtain a desired coupling factor.

Vertical inductor structures of the present disclosure can be placed in close proximity to create resonant filter chains. In a first embodiment, a resonant filter chain comprises at least two vertical inductor structures of the present disclosure wherein widths of at least four solid via columns of a vertical inductor structure of the present disclosure are equal and a coupling factor between the vertical inductor structures of the resonant filter chain is small or substantially zero. In a second embodiment, a resonant filter chain comprises at least two vertical inductor structures of the present disclosure wherein widths of at least four solid via columns of a vertical inductor structure of the present disclosure are not equal and a coupling factor between the vertical inductor structures of the resonant filter chain of the second embodiment is small, but not zero.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

DETAILED DESCRIPTION

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

The present disclosure provides a vertical inductor structure with a high quality (Q) factor, a magnetic field of the vertical inductor structure closed to an interior of the vertical inductor structure, and a coupling factor that is small, or substantially zero. The vertical inductor structures of the present disclosure significantly reduce the amount of space taken up by resonant circuitry on a circuit board of a mobile device. However, the present disclosure is not limited to such environments and can be used in any environment in which an inductor is used.

Figure 1:
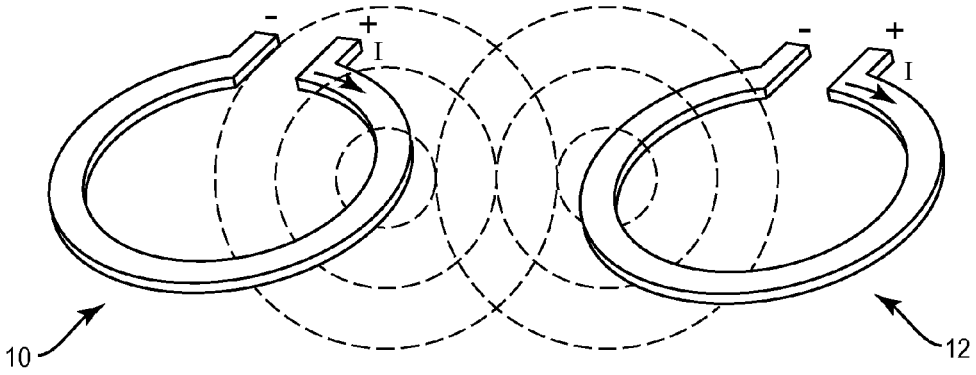
FIG. 1 RELATED ART
FIG. 1 illustrates conventional planar loop inductors from related art.
Figure 2:
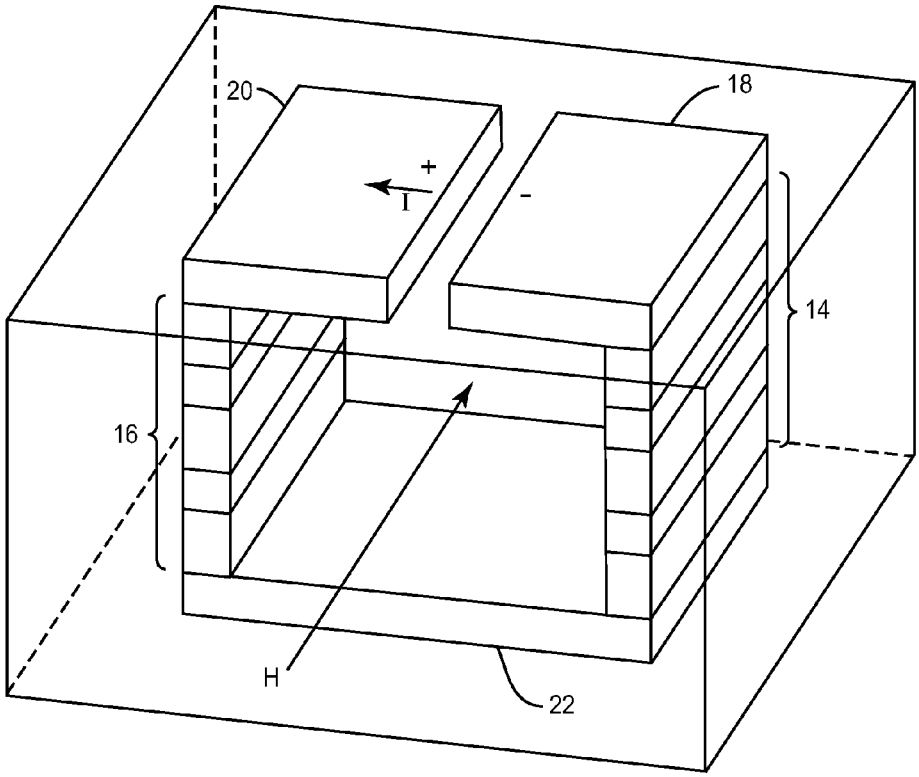
FIG. 2 illustrates a vertical inductor structure of the present disclosure.

FIG. 2 demonstrates a first embodiment of a vertical inductor structure created in a substrate by stacking several layers of solid via bars to create solid via columns 14 and 16 that can be connected to terminal plates 18 and 20 on a top of the solid via columns 14 and 16 and a connector plate 22 on a bottom of the solid via columns 14 and 16. The substrate may be any type of substrate made from suitable non-conductive material(s) and/or semiconductor material(s). Exemplary non-conductive materials include laminate, a semiconductor material, glass, a dielectric, plastic, fiber, and/or the like. Exemplary semiconductor materials include Silicon (Si), Silicon Germanium (SiGe), Gallium Arsenide (GaAs), Indium Phosphorus (InP), and/or the like. The substrate may also be single layered or multi-layered. Conductive structures (e.g., the vertical inductor structure shown in FIG. 2, connection paths, transmission paths, contact pads, terminals, passive circuit elements, etc.) may be formed on and/or within the substrate. The conductive structures may be metallic structures made from any type of metal(s) including, for example, copper (Cu), gold (Au), silver (Ag), Nickel (Ni), metallic alloys, and/or the like. Conductive materials may also be non-metallic conductive materials (e.g., graphene). In this embodiment, the substrate is a multi-layered substrate made from a laminate. The multi-layered substrate thus includes a plurality of laminated substrate layers and metallic structures formed on and between the laminated substrate layers. The laminated substrate layers may be formed from laminates such as FR-1, FR-2, FR-3, FR-4, FR-5, FR-6, CEM-1, CEM-2, CEM-3, CEM-4, CEM-5, CX-5, CX-10, CX-20, CX-30, CX-40, CX-50, CX-60, CX-70, CX-80, CX-90, CX-100, and/or the like. In this embodiment, the multi-layered substrate includes standard tube vias.

While the specific embodiments described in this disclosure are implemented using a multi-layered substrate, the vertical inductor structures described herein are not limited to multi-layered substrates. Alternatively, the vertical inductor structures may be implemented using single-layered substrates.

With regard to the vertical inductor structure shown in FIG. 2, the terminal plates 18 and 20 and the connector plate 22 are created in conductive layers of the multi-layered substrate. The solid via bars are created in non-conductive layers and provide a connection between the connective layers in the multi-layered substrate to create the solid via columns 14 and 16. A magnetic field H of the vertical inductor structure is parallel to the design plane of the multi-layered substrate, reducing the coupling factor of the vertical inductor structure. A width of the solid via columns 14 and 16 can be increased to improve the metal density of the vertical inductor structure to achieve a high quality (Q) factor without increasing the inductive resistance of the vertical inductor structure of FIG. 2. However, the magnetic field H of the vertical inductor structure of FIG. 2 is still open outside the vertical inductor structure, limiting the proximity in which the vertical inductor structure can be placed to other vertical inductor structures.

Figure 3:
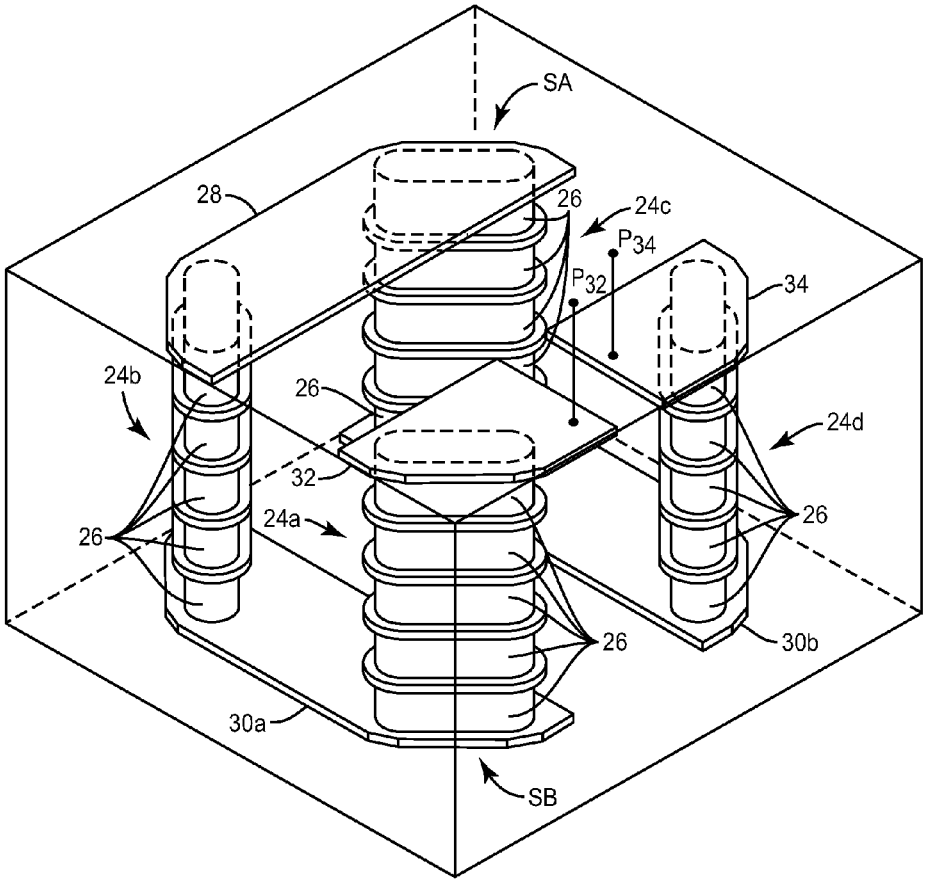
FIG. 3 illustrates a second embodiment of a vertical inductor structure of the present disclosure.

A second embodiment of a vertical inductor structure of the present disclosure is shown in FIG. 3. The vertical inductor structure comprises four solid via columns (referred to generically as element 24, and specifically as solid via columns 24*a*, 24*b*, 24*c*, and 24*d*). Each of the solid via columns 24 comprises solid via bars 26. The vertical inductor structure of FIG. 3 also comprises three connector plates 28, 30*a*, and 30*b*. The connector plate 28 connects the solid via column 24*b* to the solid via column 24*c* on a first side SA of the vertical inductor structure. On a second side SB of the vertical inductor structure that is antipodal to the first side SA, the connector plate 30*a* connects the solid via column 24*a* to the solid via column 24*b*, and the connector plate 30*b* connects the solid via column 24*c* to the solid via column 24*d*. The vertical inductor structure of FIG. 3 further comprises two terminal plates 32 and 34. The terminal plates 32 and 34 comprise a terminal connection for the vertical inductor structure and are connected to the solid via columns 24*a*, 24*d*, respectively, at the first side SA. The terminal plates 32 and 34 can be connected to ports $P_{32}$ and $P_{34}$, respectively, for connection to an external component, such as, but not limited to, a tunable capacitor. Note that the vertical inductor structure shown in FIG. 3 is also a three-dimensional inductor structure. Furthermore, while the vertical inductor structure in FIG. 3 is cubic, other embodiments of the vertical inductor structure may be any shape. For example, an alternative embodiment of the vertical inductor structure may be spherical.

Current from the port $P_{32}$ flows to and across the terminal plate 32 down the solid via column 24*a* to the connector plate 30*a*. The current flow continues across the connector plate 30*a* up through the solid via column 24*b* to the connector plate 28. The current flow then continues across the connector plate 28 down through the solid via column 24*c* to the connector plate 30*b*. The current flow continues up through the solid via column 24*d* to the terminal plate 34 and up through the port $P_{34}$. Since the current direction of one solid via column 24 is parallel to an adjacent solid via column 24 (for example, the adjacent solid via columns 24*a* and 24*b*), the magnetic fields generated from each individual solid via column 24 cancel each other, confining the magnetic field to the interior of the vertical inductor structure of FIG. 3. Thus, the vertical inductor structure of FIG. 3 contains a small, or substantially zero, coupling factor. As such, the solid via columns 24*a*-24*d*, the connector plates 28, 30*a*, 30*b*, and the terminal plates 32, 34 are arranged such that the magnetic field generated by the vertical inductor structure is substantially confined to the interior of the vertical inductor structure.

Figure 4A:
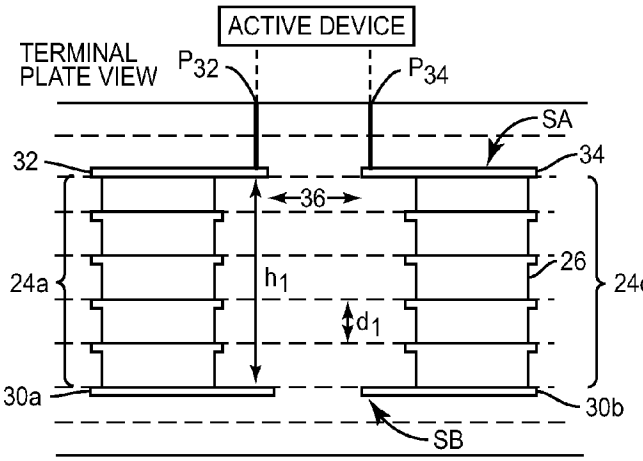
FIG. 4A illustrates a cross-section terminal view of the terminal side of the first embodiment in a multi-layered substrate.
Figure 4B:
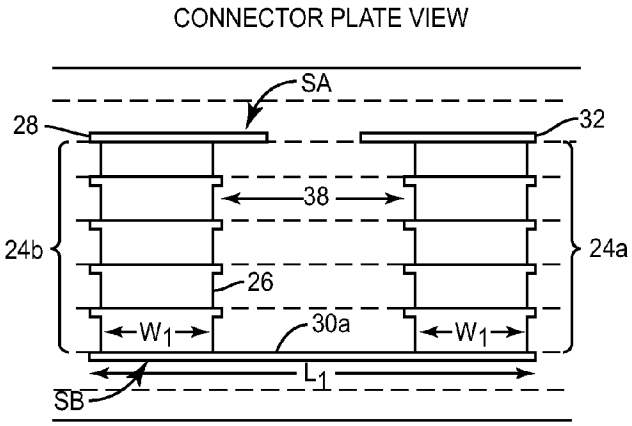
FIG. 4B illustrates a cross-section side view of the first embodiment in the multi-layered substrate.
Figure 4C:
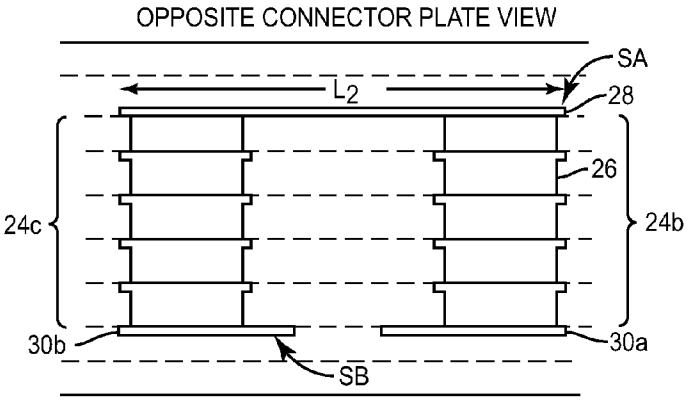
FIG. 4C illustrates a cross section terminal view opposite of the terminal side of the first embodiment in the multi-layered substrate.

FIGS. 4A-4C provide cross-section views of the vertical inductor structure of FIG. 3 in the multi-layered substrate. Note that the vertical inductor structure shown in FIGS. 4A-4C is also a three-dimensional inductor structure. In particular, FIG. 4A provides a cross-section view of the terminal side of the vertical inductor structure of FIG. 3. In FIG. 4A, the ports $P_{32}$ and $P_{34}$ extend from the surface of the multi-layered substrate down to the respective terminal plates 32 and 34. Placing the vertical inductor structure of FIG. 3 in the substrate enables an active device, such as, but not limited to, a tunable capacitor, to be attached right above the vertical inductor structure on the surface of the multi-layered substrate to maintain a low series resistance between the vertical inductor structure and the active device, and to ensure homogenous injection of current between the vertical inductor structure and the active device. This arrangement also greatly reduces the amount of space resonant circuitry comprising the vertical inductor structure of the present disclosure takes up in the multi-layered substrate.

FIG. 4A also provides a cross-section view of a gap 36 between the terminal plates 32 and 34. The gap 36 between the terminal plates 32 and 34 must be a minimum of approximately 50 microns to keep electrical separation between the terminal plates 32 and 34. It is also advantageous that the ports $P_{32}$ and $P_{34}$ are respectively connected to substantially the edge of the terminal plates 32 and 34 for proper current flow throughout the vertical inductor structure of the present disclosure.

The cross-section view shown in FIG. 4A also demonstrates how a height $h_1$ of the solid via bars 26 correspond to a depth $d_1$ of the substrate layers, which may range between approximately 50 microns and 80 microns. As shown, the height $h_1$ of the solid via column 24*a* is dependent upon the depth $d_1$ and the number of the solid via bars 26 available to create the solid via columns 24. For example, the height $h_1$ of the solid via columns 24*a*-24*d* shown in FIGS. 4A-4C would be approximately 250 microns to 400 microns if the depth $d_1$ ranges from approximately 50 microns to 80 microns. However, the height $h_1$ of the solid via columns 24 of the present disclosure may be taller or shorter depending upon the number of solid via bars 26 used to construct the vertical inductor structure and the depth $d_1$ of each of those solid via bars 26.

The high Q factor and the small coupling factor of the vertical inductor structure of FIG. 3 can be adjusted by either increasing or decreasing widths $w_1$ of the solid via columns 24*a* and 24*b* shown in FIG. 4B. The width $w_1$ of the solid via columns 24*a* and 24*b* can be increased to improve a metal density of the vertical inductor structure and to achieve a high Q factor without increasing an inductive resistance of the vertical inductor structure of FIG. 3. However, the width $w_1$ cannot be increased such that a spacing 38 between the solid via columns 24*a* and 24*b* is smaller than approximately 150 microns, which is the amount of space need to provide an electrical separation between the solid via columns 24*a* and 24*b*.

A length $L_1$ of the connector plate 30*a* shown in FIG. 4B is dependent upon the width $w_1$ of the solid via columns 24*a* and 24*b* and the size of the spacing 38 to achieve a specific high Q value. Typically, a high Q value would be equal or higher than a value of 100. For example, if the desired widths $w_1$ of the solid via columns 24*a* and 24*b* is approximately 400 microns, and the spacing 38 is approximately 400 microns, then the length $L_1$ of the connector plate 30*a* would be approximately 1200 microns. However, the width $w_1$, the spacing 38, and the length $L_1$ of the connector plate 30*a* may be larger or smaller, depending upon the desired Q factor and coupling factor of the vertical inductor structure of the present disclosure.

In accordance with the vertical inductor structure of FIG. 3 of the present disclosure, although not shown, the solid via columns 24*c* and 24*d* possess the same width $w_1$ of the solid via columns shown in FIG. 4B. A spacing between the solid via columns 24*c* and 24*d* also would be the same as the spacing 38 shown in FIG. 4B.

FIG. 4C shows the opposite terminal view of the vertical inductor structure of FIG. 3 within the substrate. A length $L_2$ of the connector plate 28 is also substantially long enough to connect the tops of the solid via columns 24*b* and 24*c*. In order to ensure that the path length the current travels is equal in each turn of the vertical inductor structure of FIG. 3, the length $L_2$ of the connector plate 28 is substantially equal to the length $L_1$ of the connector plate 30*a* shown in FIG. 4B. For example, if the length $L_1$ of the connector plate 30*a* of FIG. 4B is approximately 1200 microns, the length $L_2$ of the connector plate 14 will also be approximately 1200 microns. In one embodiment, the terminal plates 32, 34, and the connector plates 28 and 30 are each approximately 20 microns.

Figure 5A:
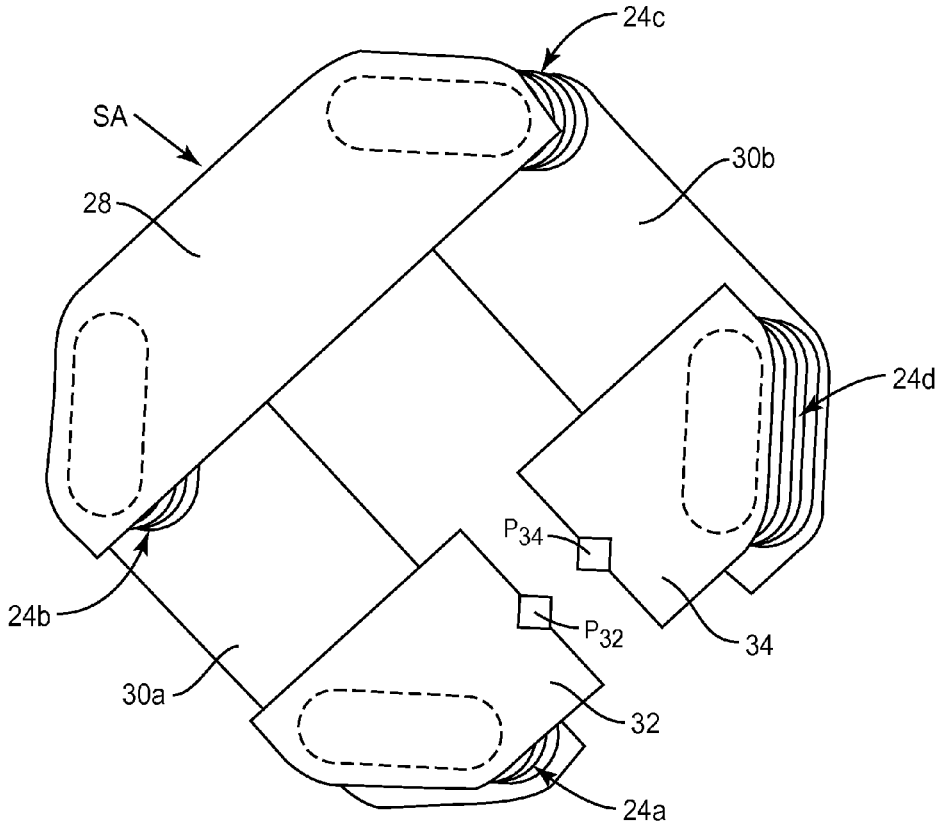
FIG. 5A illustrates a top-down view of the first embodiment of the vertical inductor structure with a first embodiment of port connections to terminal plates of the vertical inductor structure of the present disclosure.

FIG. 5A provides a top-down view of the vertical inductor structure of FIG. 3 from the first side SA, and demonstrates the advantageous connection location for the ports $P_{32}$ and $P_{34}$. The advantageous placement of the port connections as shown in FIG. 5A enables the current flow in each of the solid via columns 24*a*-24*d* to have substantially equal magnitudes. Since the current flow of one solid via column 24*a*, 24*b*, 24*c*, 24*d* is equal in magnitude but in the opposite direction in comparison to the current flows of the adjacent solid via columns (24*b*, 24*d*), (24*a*, 24*c*), (24*b*, 24*d*), (24*a*, 24*c*) respectively, the magnetic fields from each of the individual solid via columns 24 cancel one another, closing the magnetic field to the interior of the vertical inductor structure of FIG. 3. This enables the coupling factor of the vertical inductor structure of FIG. 3 to be small, or substantially zero.

Figure 5B:
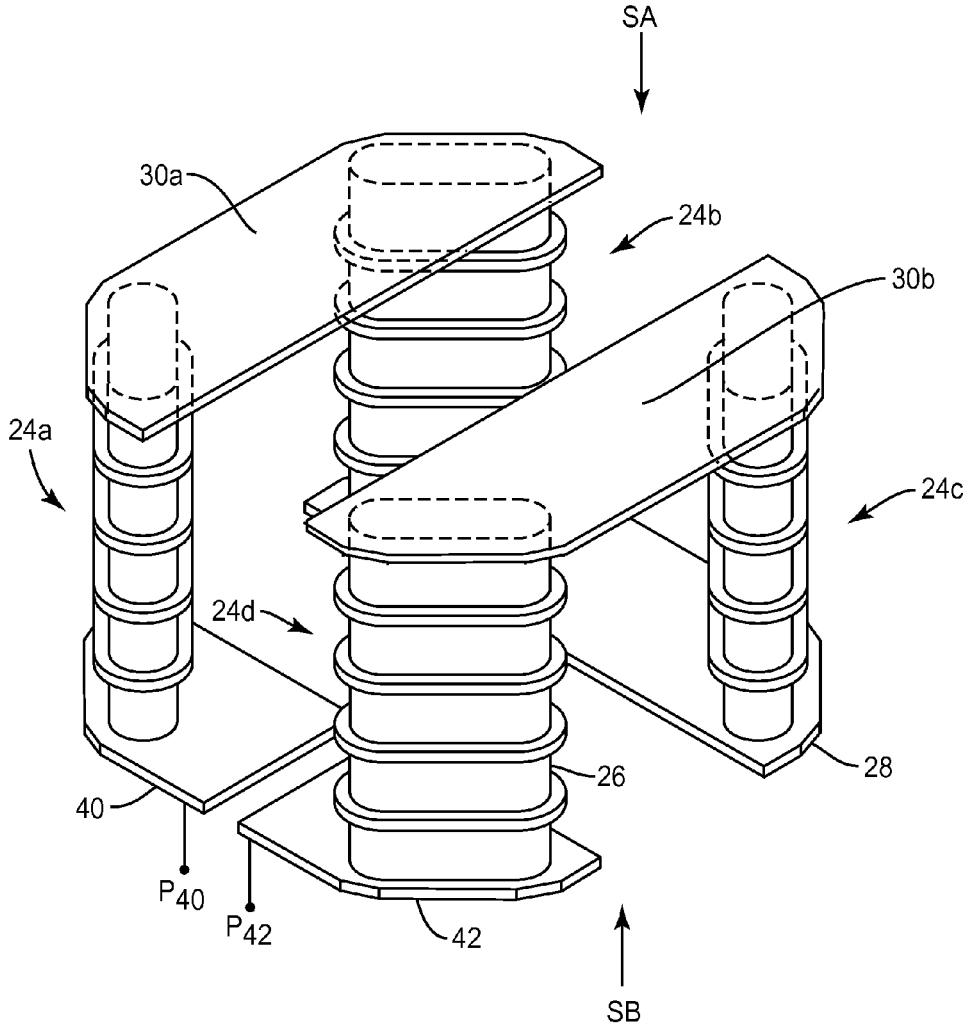
FIG. 5B illustrates a second embodiment of the vertical inductor structure of the present disclosure with a second embodiment of the terminal plates of the present disclosure.

In another embodiment, FIG. 5B demonstrates an alternative placement for the terminal connection of the vertical inductor structure of FIG. 3 in accordance with the present disclosure. Instead of placing the terminal connection on a top of the vertical inductor structure of the present disclosure, a terminal connection comprising terminal plates 40 and 42 may be placed on the second side SB of the vertical inductor structure as shown in FIG. 5B. An external component can connect to the bottom of the vertical inductor structure of the present disclosure via ports $P_{40}$ and $P_{42}$. The ports $P_{40}$, $P_{42}$ may be terminals, other plates, nodes, solder bumps, and/or any other type of connecting component or location. The vertical inductor structure of FIG. 5B is the same as the vertical inductor structure of FIG. 5A, except that the vertical inductor structure in FIG. 5B was formed to be oriented antipodally with respect to the first side SA and the second side SB. Thus, FIG. 5B demonstrates that the vertical inductor structure can have any orientation. The vertical inductor structure of the present disclosure may be used to create resonant circuitry, such as, but not limited to, tunable duplexers and band pass filters. Note that the vertical inductor structure shown in FIGS. 5A and 5B is also a three-dimensional inductor structure.

Figure 6:
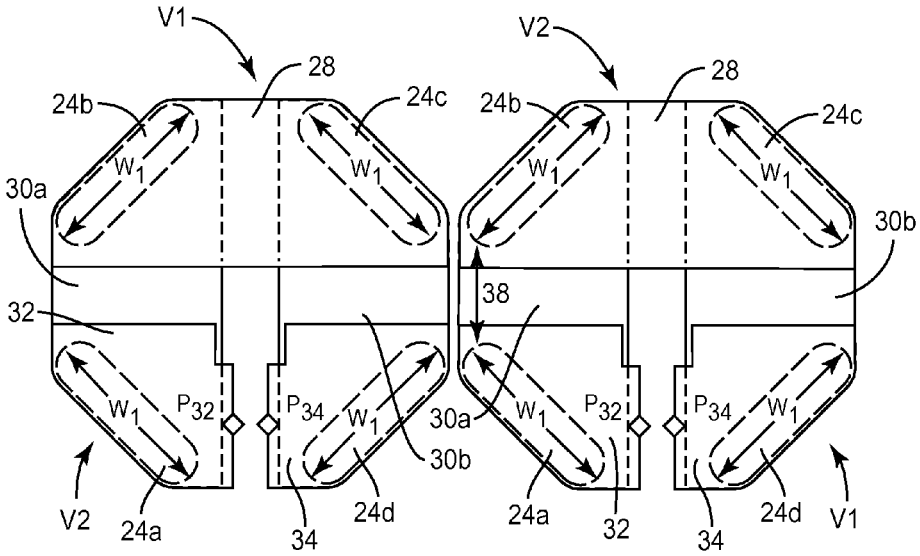
FIG. 6 illustrates a first embodiment of a resonant filter chain comprising at least two of the vertical inductor structures of the present disclosure.

FIG. 6 illustrates embodiments of two vertical inductor structures V1, V2, which are each the same as the vertical inductor structure shown in FIGS. 3-5A. As shown, the vertical inductor structures V1, V2 are placed in close proximity due to the small, or substantially zero, coupling factor of each of the vertical inductor structures V1, V2. It should be appreciated by those skilled in the art that several vertical inductor structures V1, V2 can be connected in series, and thus in close proximity, to create a resonant filter. The inductor structure V1 and the inductor structure V2 are thus arranged so as to generate a substantially confined magnetic field. In this example, the vertical inductor structures V1, V2 of the present disclosure are symmetrical in that the widths $w_1$ of the solid via columns 24 of both of the vertical inductor structures V1, V2 are equal and the spacing 38 between the solid via columns 24 of both of the vertical inductor structures V1, V2 is such that a small, or substantially zero, coupling factor exists between the two vertical inductor structures V1, V2. However, it may be desired to achieve a non-zero coupling factor between the two vertical inductor structures V1, V2 of the present disclosure to achieve a particular function of a filter comprising vertical inductor structures of the present disclosure, such as, but not limited to, filtering for a specific transfer function of a signal. Note that the vertical inductor structures V1, V2 shown in FIG. 6 are each a three-dimensional inductor structure.

Figure 7:
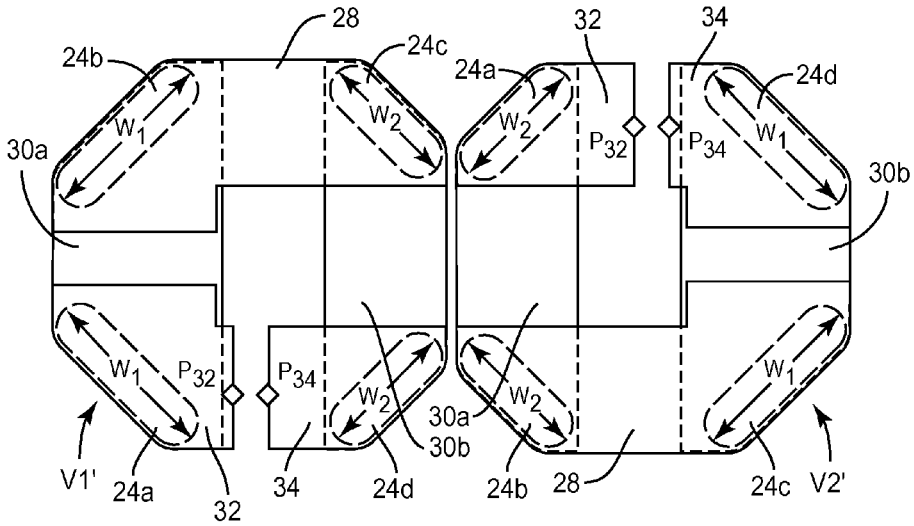
FIG. 7 illustrates a second embodiment of a resonant filter chain comprising at least two of the vertical inductor structures of the present disclosure.

FIG. 7 illustrates embodiments of vertical inductor structure V1' and V2', which are each the same as the vertical inductor structure shown in FIGS. 3-5A. Note that the vertical inductor structures V1', V2' shown in FIG. 7 are each a three-dimensional inductor structure. As in the vertical inductor structures V1, V2 of FIG. 6, the solid via columns 24*a*, 24*b* of the vertical inductor structure V1' and the solid via columns 24*c*, 24*d* of the vertical inductor structure V2' each have widths $w_1$. However, unlike in the vertical inductor structures V1, V2 of FIG. 6, the solid via columns 24*c*, 24*d* of the vertical inductor structure V1' and the solid via columns 24*a*, 24*b* of the vertical inductor structure V2' have width $w_2$. Thus, the solid via columns 24*c*, 24*d* of the vertical inductor structure V1' that are adjacent to the solid via columns 24*a*, 24*b* of the vertical inductor structure V2' are formed to have widths $w_2$. Accordingly, the solid via columns 24 of the vertical inductor structure V1' have unequal widths $w_1$, $w_2$. Similarly, the solid via columns 24 of the vertical inductor structure V2' have unequal widths $w_1$, $w_2$. The widths $w_2$ of adjacent solid via columns 24, as shown in FIG. 7, are smaller than the widths $w_1$. Increasing the spacing 38 by shrinking the widths $w_2$ controls leakage of the magnetic fields of the vertical inductor structures V1', V2', and thus controls and achieves a non-zero coupling factor between the two vertical inductor structures V1', V2'. The inductor structure V1' and the inductor structure V2' are arranged so as to generate a substantially confined magnetic field.

Resonant circuitry comprising the vertical inductor structures V1, V2, V1', V2' in FIGS. 6 and 7 have high Q factors and the small coupling factors, while utilizing much less space on a circuit board than traditional inductors, since the vertical inductor structures V1, V2, V1', V2' can be placed in close proximity.

Figure 8:
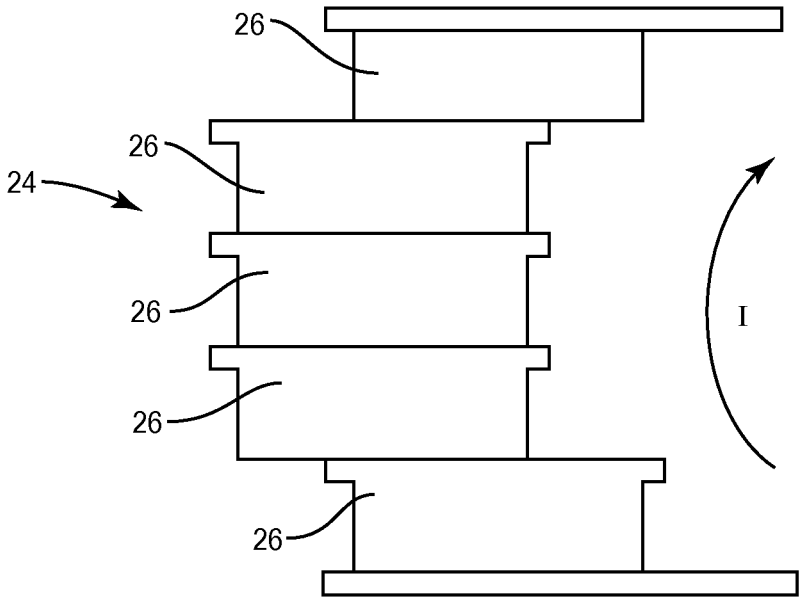
FIG. 8 illustrates an alternative embodiment to stacking solid via bars to create solid via columns of the present disclosure.

FIG. 8 shows one embodiment of one of the solid via columns 24. As shown in FIG. 8, the solid via bars 26 of the solid via columns 24 of the present disclosure may be stacked in such a manner that a top solid via bar 26 and a bottom solid via bar 26 of a solid via column 24 are offset from the solid via bars 26 in the middle of the solid via column 24 to create a curved solid via column 24. A curvature I in the solid via column 24 may improve the current flow throughout the vertical inductor structure and thus raise the Q factor of the vertical inductor structure of the present disclosure. One or more of the solid via columns 24 shown in FIGS. 1-7 may be stacked in the same manner as the solid via columns 24 shown in FIG. 8.

Those skilled in the art will recognize improvements and modifications to the preferred embodiments of the present disclosure. All such improvements and modifications are considered within the scope of the concepts disclosed herein and the claims that follow.

What is claimed is:

1. An inductor structure in a substrate comprising:

a first connector plate;

a second connector plate;

a third connector plate;

a first terminal plate;

a second terminal plate;

a first elongated via column that is elongated along a first plane, wherein the first elongated via column connects the first terminal plate to the first connector plate;

a second elongated via column that is elongated along a second plane, wherein the second elongated via column connects the second terminal plate to the second connector plate and wherein the first elongated via column and the second elongated via column are positioned such that the first plane is substantially perpendicular to the second plane;

a third elongated via column that is elongated along a third plane, wherein the third elongated via column connects the first connector plate to the third connector plate and wherein the third elongated via column is positioned such that the third plane is substantially perpendicular to the first plane and is substantially parallel to the second plane;

a fourth elongated via column that is elongated along a fourth plane, wherein the fourth elongated via column connects the second connector plate to the third connector plate and wherein the fourth elongated via column is positioned such that the fourth plane is substantially perpendicular to the both the second plane and the third plane and is substantially parallel to the first plane; and wherein the third connector plate is connected from the third elongated via column to the fourth elongated via column such that the third connector plate is substantially perpendicular to the first connector plate and the second connector plate and such that current propagates in opposite directions through the first connector plate and the second connector plate.

2. The inductor structure of claim 1, wherein least two terminal plates the first terminal plate and the second terminal plate enable an active device on the substrate to be connected to the inductor structure in the substrate.

3. The inductor structure of claim 1, wherein the first terminal plate, the second terminal plate the first connector plate, the second connector plate, and the third connector plate are created with conductive layers of the substrate.

4. The inductor structure of claim 1, wherein the first elongated via column, the second elongated via column, the third elongated via column, and the fourth elongated via column are created in non-conductive layers of the substrate.

5. The inductor structure of claim 4, wherein:

the first elongated via column is formed from a first stack of solid via bars;

the second elongated via column is formed from a second stack of solid via bars;

the third elongated via column is formed from a third stack of solid via bars;

the fourth elongated via column is formed from a fourth stack of solid via bars; and a height of the solid via bars in the first stack, the second stack, the third stack, and the fourth stack each corresponds to a depth of a non-conductive layer of the substrate.

6. The inductor structure of claim 5, wherein a height of the first solid via column, the second elongated via column, the third elongated via column, and the fourth elongated via column each corresponds to the height of the at least one solid via bar.

7. The inductor structure of claim 6, wherein the first solid via column, the second elongated via column, the third elongated via column, and the fourth elongated via column are each stacked vertically in the substrate.

8. The inductor structure of claim 1, wherein the inductor structure has a high quality (Q) factor.

9. The inductor structure of claim 8, wherein a value of the high Q factor is greater or equal to 100.

10. The inductor structure of claim 8, wherein the value of the high Q factor is increased by increasing a width of each of the first solid via column, the second elongated via column, the third elongated via column, and the fourth elongated via column.

11. The inductor structure of claim 1, wherein the inductor structure is configured to generate a magnetic field such that the magnetic field is closed to an interior of the inductor structure.

12. The inductor structure of claim 11, wherein each of the first solid via column, the second elongated via column, the third elongated via column, and the fourth elongated via column has a column width so that the column width of each of the first solid via column, the second elongated via column, the third elongated via column, and the fourth elongated via column are equal.

13. The inductor structure of claim 12, wherein the inductor structure is configured to provide a small coupling factor.

14. The inductor structure of claim 13, wherein the small coupling factor is substantially zero.

15. The vertical inductor structure of claim 1, wherein the vertical inductor structure is configured to generate a magnetic field, where the magnetic field is not closed to an interior of the vertical inductor structure.

16. The vertical inductor structure of claim 15, wherein the magnetic field is not closed to the interior of the vertical inductor structure when a width of each of the at least four solid via columns are not equal.

17. The vertical inductor structure of claim 16, wherein the vertical inductor structure further comprises a non-zero coupling factor.

18. The vertical inductor structure of claim 1, wherein the vertical inductor is spherical.

19. The inductor structure of claim 1, wherein the inductor structure is configured to generate a magnetic field, and wherein the first solid via column, the second elongated via column, the third elongated via column, the fourth elongated via column, the first terminal plate, the second terminal plate, the first connector plate, the second connector plate, and the third connector plate are arranged such that the magnetic field is substantially confined to an interior of the inductor structure.

20. The inductor structure of claim 1, wherein the first elongated via column and the second elongated via column are each configured to have a first width and the third elongated via column and the fourth elongated via column are each configured to have a second width, the first width being greater than the second width.

21. The inductor structure of claim 1, wherein the third elongated via column and the fourth elongated via column are each configured to have a first width and the first elongated via column and the second elongated via column are each configured to have a second width, the first width being greater than the second width.

22. The inductor structure of claim 1, wherein the first solid via column, the second elongated via column, the third elongated via column, the fourth elongated via column, the first connector plate, the second connector plate, and the third connector plate are coupled such that the inductor structure has a square footprint in a first direction and has a square footprint along a second direction.

23. The inductor structure of claim 1, wherein the first solid via column, the second elongated via column, the third elongated via column, the fourth elongated via column, the first connector plate, the second connector plate, and the third connector plate are coupled such that an interior of the inductor structure encloses a cube.

24. An inductor in a substrate, comprising:

a first connector plate;

a second connector plate;

a third connector plate;

a first terminal plate;

a second terminal plate;

a first elongated via column that is elongated along a first plane, wherein the first elongated via column connects the first terminal plate to the first connector plate;

a second elongated via column that is elongated along a second plane, wherein the second elongated via column connects the second terminal plate to the second connector plate and wherein the first elongated via column and the second elongated via column are positioned such that the first plane is substantially perpendicular to the second plane;

a third elongated via column that is elongated along a third plane, wherein the third elongated via column connects the first connector plate to the third connector plate and wherein the third elongated via column is positioned such that the third plane is substantially perpendicular to the first plane and is substantially parallel to the second plane;

a fourth elongated via column that is elongated along a fourth plane, wherein the fourth elongated via column connects the second connector plate to the third connector plate and wherein the fourth elongated via column is positioned such that the fourth plane is substantially perpendicular to the both the second plane and the third plane and is substantially parallel to the first plane; and wherein the third connector plate is connected from the third elongated via column to the fourth elongated via column such that the third connector plate is substantially perpendicular to the first connector plate and the second connector plate and such that current propagates in opposite directions through the first connector plate and the second connector plate.

25. The inductor of claim 24, wherein the first terminal plate and the second terminal plate enable an active device on the substrate to be connected to the vertical inductor in the substrate.

26. The inductor of claim 25, wherein the inductor structure has a high quality (Q) factor.

27. The inductor of claim 26, wherein a value of the high Q factor has is greater or equal to 100.

28. The inductor of claim 26, wherein the high Q factor is increased by increasing a width of each of the first solid via column, the second elongated via column, the third elongated via column, and the fourth elongated via column.

29. The inductor of claim 24, wherein the inductor is configured to generate a magnetic field such that the magnetic field is running parallel to a design plane of the substrate.

30. The vertical inductor of claim 24, wherein the vertical inductor is spherical.

31. The inductor of claim 24, wherein the inductor is configured to generate a magnetic field, and wherein the first solid via column, the second elongated via column, the third elongated via column, the fourth elongated via column, the first terminal plate, the second terminal plate, the first connector plate, the second connector plate, and the third connector plate are arranged such that the magnetic field is substantially confined to an interior of the inductor.

* * * * *